US010801221B2

(12) United States Patent
Secrest et al.

(10) Patent No.: US 10,801,221 B2
(45) Date of Patent: Oct. 13, 2020

(54) DEVICE FOR STABILIZING AND REPAIRING CRACKS IN CONCRETE STRUCTURES AND A METHOD FOR ITS USE

(71) Applicants: Robert Luke Secrest, Thornville, OH (US); Jarred A. Jones, Thornville, OH (US); Gary L. Fox, Circleville, OH (US); Robert K. Smith, Ancaster (CA)

(72) Inventors: Robert Luke Secrest, Thornville, OH (US); Jarred A. Jones, Thornville, OH (US); Gary L. Fox, Circleville, OH (US); Robert K. Smith, Ancaster (CA)

( * ) Notice: Subject to any disclaimer, the term of this patent is extended or adjusted under 35 U.S.C. 154(b) by 0 days.

(21) Appl. No.: 15/866,424

(22) Filed: Jan. 9, 2018

(65) Prior Publication Data

US 2019/0010719 A1 Jan. 10, 2019

Related U.S. Application Data

(60) Provisional application No. 62/444,343, filed on Jan. 9, 2017.

(51) Int. Cl.
*E02D 37/00* (2006.01)
*E04G 23/02* (2006.01)

(52) U.S. Cl.
CPC .. *E04G 23/0288* (2013.01); *E04G 2023/0251* (2013.01)

(58) Field of Classification Search
CPC ..... E04G 23/0288
USPC ..... 52/514
See application file for complete search history.

(56) References Cited

U.S. PATENT DOCUMENTS 1,223,045 A * 4/1917 Ferguson ..... E01C 11/14 404/56
2,291,162 A * 7/1942 Kirby ..... B23P 6/04 29/402.12
3,168,941 A * 2/1965 Southard, Jr. ..... B23P 6/04 29/402.12
3,619,893 A * 11/1971 Harris ..... B22D 7/066 29/402.11
4,845,828 A * 7/1989 Reed ..... B23P 6/04 29/402.15
5,063,006 A * 11/1991 Tahara ..... E04G 23/0211 264/35

(Continued)

OTHER PUBLICATIONS

PCT search report in PCT/US18/13031, dated Apr. 5, 2018.

*Primary Examiner* — Basil S Katcheves
(74) *Attorney, Agent, or Firm* — Muskin & Farmer, LLC

(57) ABSTRACT

The present concrete crack repair device (CCRD) can be comprised of two nodules connected by an elongated strip wherein the elongated strip can be narrower than the nodules in at least one plane. Both the elongated strip and the nodules can comprise carbon fibers wherein most of the carbon fibers are located within the same plane maximizing the tensile strength of the device. Installation of the CCRD can be performed by drilling holes into the surface of the concrete on either side of the crack and cutting a slot in the surface of the concrete between the two holes, or adding the holes after the slot has been cut, wherein the slot and holes are located in a line that is roughly perpendicular to the crack. The CCRD can then be installed by placing each nodule in a hole and the elongated strip within the slot.

10 Claims, 27 Drawing Sheets

(56) References Cited

U.S. PATENT DOCUMENTS

| | | | | | |
|---|---|---|---|---|---|
| 5,476,340 | A * | 12/1995 | Contrasto | E01C 7/147 | 264/35 |
| 5,771,557 | A * | 6/1998 | Contrasto | E01C 7/147 | 264/36.2 |
| 6,212,750 | B1 * | 4/2001 | Reed | B23P 6/04 | 29/402.09 |
| 6,312,541 | B1 * | 11/2001 | Hemphill | E01C 7/147 | 156/293 |
| 6,532,714 | B1 * | 3/2003 | Ferm | E01C 7/147 | 404/64 |
| 7,513,024 | B2 * | 4/2009 | Keller | B23P 6/04 | 29/402.09 |
| 2014/0099456 | A1 * | 4/2014 | Raghavendran | E04C 5/07 | 428/34.4 |
| 2014/0144095 | A1 * | 5/2014 | Blaszak | D03D 13/00 | 52/514 |
| 2015/0068154 | A1 * | 3/2015 | Merlob | E04G 23/0218 | 52/741.1 |

* cited by examiner

DEVICE FOR STABILIZING AND REPAIRING CRACKS IN CONCRETE STRUCTURES AND A METHOD FOR ITS USE

CROSS REFERENCE TO RELATED APPLICATIONS

This Application claims benefit to provisional application No. 62/444,343, which is incorporated by reference herein in its entirety.

FIELD OF THE INVENTION

The present device relates to concrete crack repair generally and concrete foundation, floor, slab and wall repair specifically.

BACKGROUND

Concrete is one of the most commonly used materials used in the construction of buildings, bridges, and roadways. Even though concrete is one of the most durable materials available, cracking can, and often does occur for a number of different reasons. Some cracks may be caused by shrinkage and do not pose any structural issues while other cracks, caused by excessive loads or inadequate support, need to be repaired in order to maintain the structural integrity of the concrete structure.

If cracks develop in concrete where the two sides of the crack begin moving independently from one another serious problems may occur weakening the integrity of the structure and resulting in further damage to it. In some cases, open cracks can allow water, radon gas, or other unwanted substances to enter the structure. Additionally, water intrusion can result in corrosion of the reinforcing steel further weakening of the structure.

There are several methods currently used for concrete crack repair. Cracks can be filled on the surface or material can be injected into them. However, when one of these solutions is used, it is likely that the crack will open back up or a new crack will occur beside the repair.

In order to add more structural stability to the crack repair, several metal products have been developed to stitch the crack back together. These products are cut into the concrete and provide strength across the crack. See U.S. Pat. No. 6,532,714 by Ferm et al. and U.S. Pat. No. 5,476,340 by Contrasto for two examples of such products. One drawback to using these devices is that there is a possibility of corrosion whenever metal is used, and that the strength of the repair depends on the bond strength of the epoxy or grout that is used to install them.

Carbon fiber staples were developed to eliminate problems relating to corrosion mentioned above as carbon fiber does not corrode. These carbon fiber staples are placed into wide cuts made into the surface of the concrete and epoxied in place. Even though the staple turns 90 degrees on both ends, the strength of these products remains a function of the epoxy bond strength as much or more than the strength of the carbon fiber itself since the threads of the carbon fiber do not run in the same plane throughout the length of the staple, which is critically important to maximize the tensile strength throughout any repair device comprised of carbon fiber.

What is needed is a product for repairing cracks in concrete, which is made of carbon fiber to eliminate concerns about corrosion, but where the threads of the carbon fiber run in the same plane throughout the repair device, and provide a positive lock on both ends, which does not rely on epoxy bond strength.

SUMMARY OF THE INVENTION

It is an aspect of the present inventive concept to provide a carbon fiber product for repairing cracks in concrete in which the threads of the carbon fiber run in the same plane throughout the repair device, and wherein the product comprises a positive lock connecting the product on both ends which does not rely on epoxy bond strength.

The above aspect can be achieved by a concrete crack repair device, comprising: an elongated strip of carbon fibers, wherein substantially all of the carbon fibers are located within the same plane, and wherein the elongated strip of carbon fibers comprises a first end and a second end and the elongated strip of carbon fibers comprises a first nodule at the first end and a second nodule at the second end, and wherein the first nodule is connected to the second nodule by a connecting strip which is also comprised of the same elongated strip of carbon fibers.

The above aspect can be achieved by a method for installing a concrete crack repair device comprising: providing a concrete crack repair device comprising an elongated strip of carbon fibers, wherein substantially all of the carbon fibers are located within the same plane, and wherein the elongated strip of carbon fibers comprises a first end and a second end and the elongated strip of carbon fibers comprises a first nodule at the first end and a second nodule at the second end, and wherein the first nodule is connected to the second nodule by a connecting strip which is also comprised of the same elongated strip of carbon fibers; providing a concrete surface comprising at least one crack to be repaired, wherein the crack has a first side and second side; creating an opening in the concrete surface by drilling a first hole sufficient to contain the first nodule on one the first side of the crack to be repaired and drilling a second hole on the second side of the crack to be repaired; cutting a slot connecting the first hole to the second hole; and placing the concrete crack repair device in the opening in the concrete surface by placing the first nodule in the first hole and the second nodule in the second hole so that the connecting strip is located in the slot.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which.

DETAILED DESCRIPTION

Figure 1:
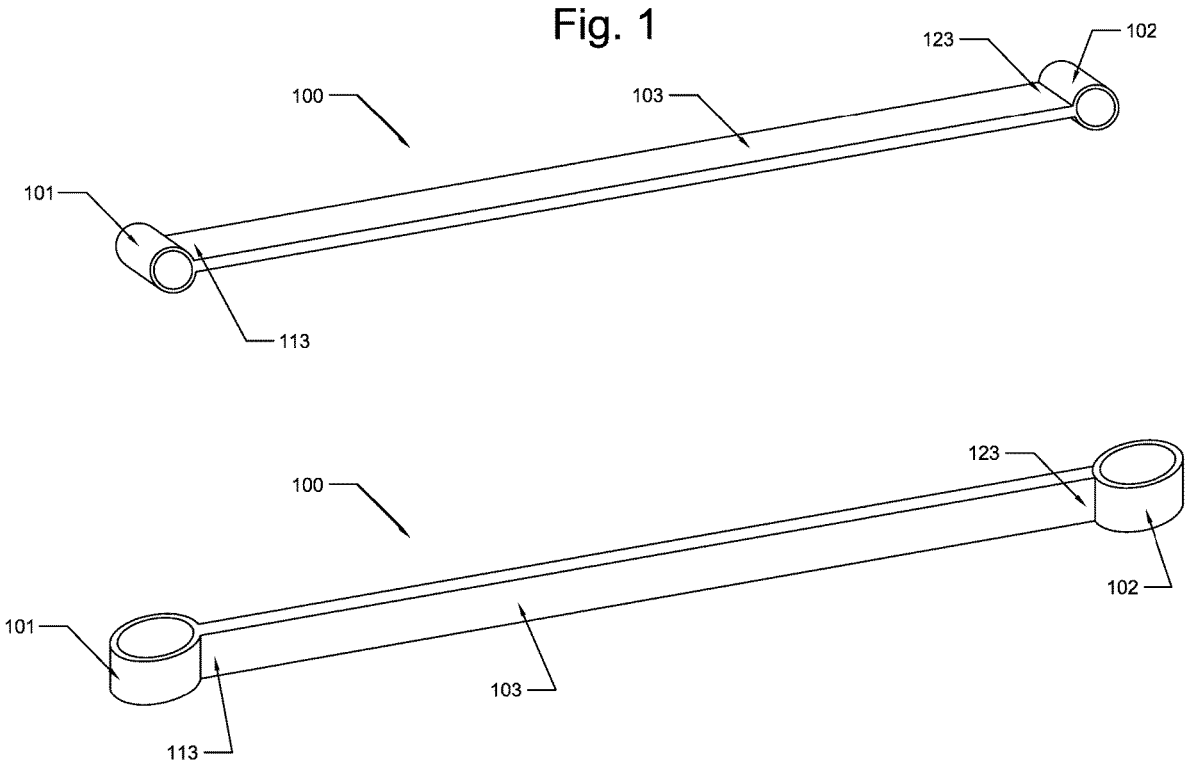
FIG. 1 is a top and side perspective view of a concrete crack repairing device (CCRD) according to an embodiment.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Reference will now be made in detail to the presently preferred embodiments of the invention, examples of which are illustrated in the accompanying drawings, wherein like reference numerals refer to like elements throughout.

In an embodiment, the present concrete crack repair device (CCRD) can be composed of a single piece of unidirectional carbon fiber that is wrapped continuously around two pieces of evenly spaced carbon fiber rebar or a device or material having physical characteristics similar to carbon fiber rebar. The CCRD can be elongated, having a length than can be between ten to fifteen inches in some embodiments, wherein most of this length is comprised of a thin strip, or band of carbon fiber that can be one to three centimeters wide and one to three millimeters thick, though the CCRD can be of any length and the band of carbon fiber can be of any width or thickness. The dimensions of the CCRD can be adapted to meet the requirements of any particular repair. The band or strip can be comprised of multiple thinner bands or strips of carbon fiber in some embodiments. According to an embodiment, the band or strip can be impregnated with an epoxy or other similar material, in order to give the CCRD a desired rigidity. It has been shown to be advantageous that the individual fibers comprising the band or strip be located within the same plane. In other words, all of these fibers can be running in the same direction, in the same plane, so that tensile stress can be exerted on all of the fibers located in that same plane.

In an embodiment, a roughly cylindrical nodule can comprise each end of the thin strip of carbon fiber. By connecting the two sides of a section of concrete, or similar material, which has been divided by a crack, the tensile strength of the CRD can bind the two sections of concrete together thus stabilizing the crack and preventing further damage to the wall or floor or similar concrete structure comprising the cracked section of concrete. According to an embodiment, the CCRD can be embedded into the concrete using commonly used and commonly available tools for working with concrete, namely drills and saws. As will be discussed in more detail below, two shallow holes can be drilled into the concrete in predetermined locations on either side of a crack at a distance apart that is specific to the length of CCRD being used. The two holes can then be connected by using a concrete saw, or similar device capable of cutting concrete, to cut a narrow channel from one hole to the other. This channel can be roughly perpendicular to the crack according to an embodiment. When the holes and channel are properly constructed, each nodule of the CCRD can be placed in each respective drilled hole, one nodule per drilled hole, and the thin strip of carbon fiber can be placed in the channel such that a small amount of tension is placed on the thin strip of carbon fiber created by pressure created when the nodules are each placed within their respective holes. In an embodiment, the nodules are too large to pass through the channel, and thus the tensile strength of the CCRD can be exerted by the nodules bearing on the inner surface of each hole, thus creating a positive lock across the crack being repaired. This tension ensures that all of the individual carbon fibers comprising the strip are all being engaged making the thin strip of carbon fiber more effective and less likely to fail, by maximizing the tensile strength of the CCRD. Specifically, the geometry of the CCRD puts all of the carbon fiber in the same plane as opposed to the concrete reinforcing staple that has tails on both ends that are orientated at 90 degrees to the staples length.

FIG. 1 is a top and side perspective view of a concrete crack repairing device (CCRD) 100 according to an embodiment. This view shows the generally thin and elongated shape of the CCRD 100 comprising bulbous nodules 101, 102 located at each end of a connecting strip of carbon fiber 103 according to an embodiment. It is contemplated that a wide range of dimensions could work effectively so long as the CCRD 100 retains the basic shape of a strip of carbon fiber 103 comprising a first nodule 101 at a first end 113 of the strip of carbon fiber 103 and a second nodule 102 at the second end 123 of the connecting strip of carbon fiber 103. For instance, in an alternative embodiment the nodules, 101 and 102, could be square or triangular rather than round and still be effective. Likewise, the length, width and thickness of the connecting strip of carbon fiber 103 could be varied to be more better suited for repairing cracks of various widths and depths as well as to adjust the amount of tensile strength of a particular CCRD to accommodate situational requirements. Generally speaking, more carbon fibers should have greater tensile strength and fewer fibers should have less.

Figure 2:
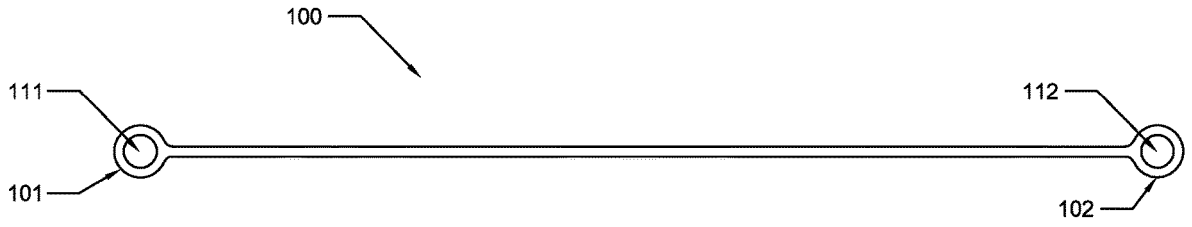
FIG. 2 is a top view of the CCRD shown in FIG. 1, according to an embodiment.

FIG. 2 is a top view of the CCRD 100 shown in FIG. 1, according to an embodiment. This view shows the thickness of the thin strip of carbon fiber 102 relative to that of the bulbous nodules 101. Additionally, this view shows how the first nodule 101 can comprise a first nodule hole 111 and the second nodule 102 can comprise a second nodule hole 112 according to an embodiment. As discussed in more detail below, a cylindrical piece of carbon fiber rebar, or other suitable material can be placed in each nodule hole 111, 112 according to an embodiment.

Figure 2A:
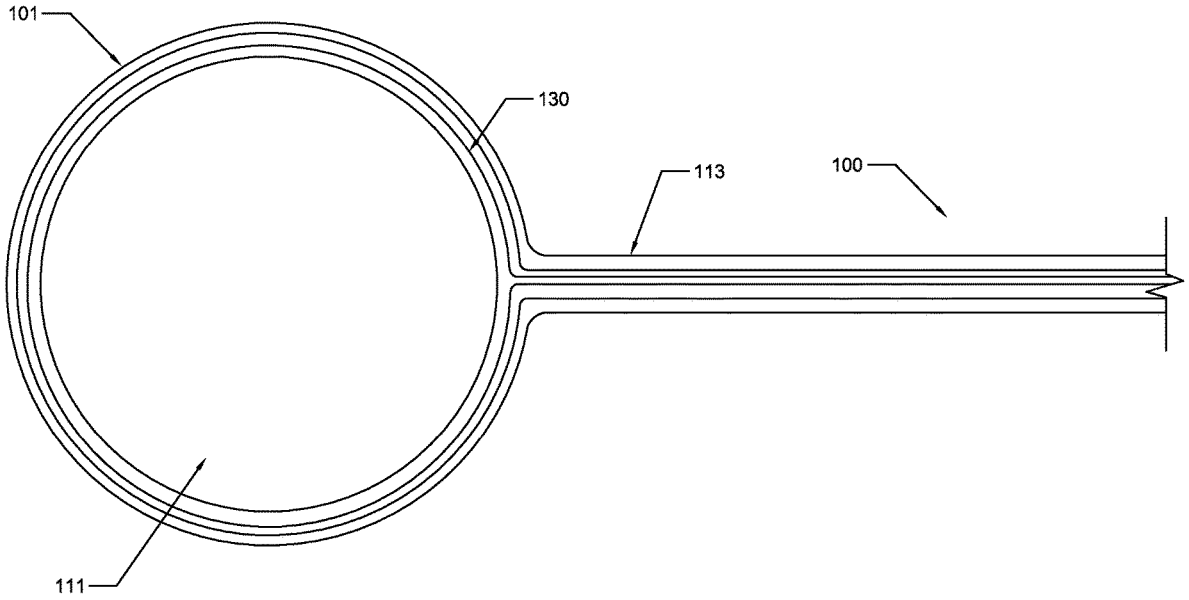
FIG. 2A is a magnified top view of the first end, comprising a first nodule of the CCRD shown in FIGS. 1 and 2, according to an embodiment.

FIG. 2A is a magnified top view of the CCRD 100 shown in FIGS. 1 and 2, including of the first end 113 comprising the first nodule 101 and the first nodule hole 111, according to an embodiment. In this magnified view, a representation of how a single strip of carbon fiber 130, shown as a single line, can be woven back and forth to create the CCRD 100, according to an embodiment.

Figure 3:
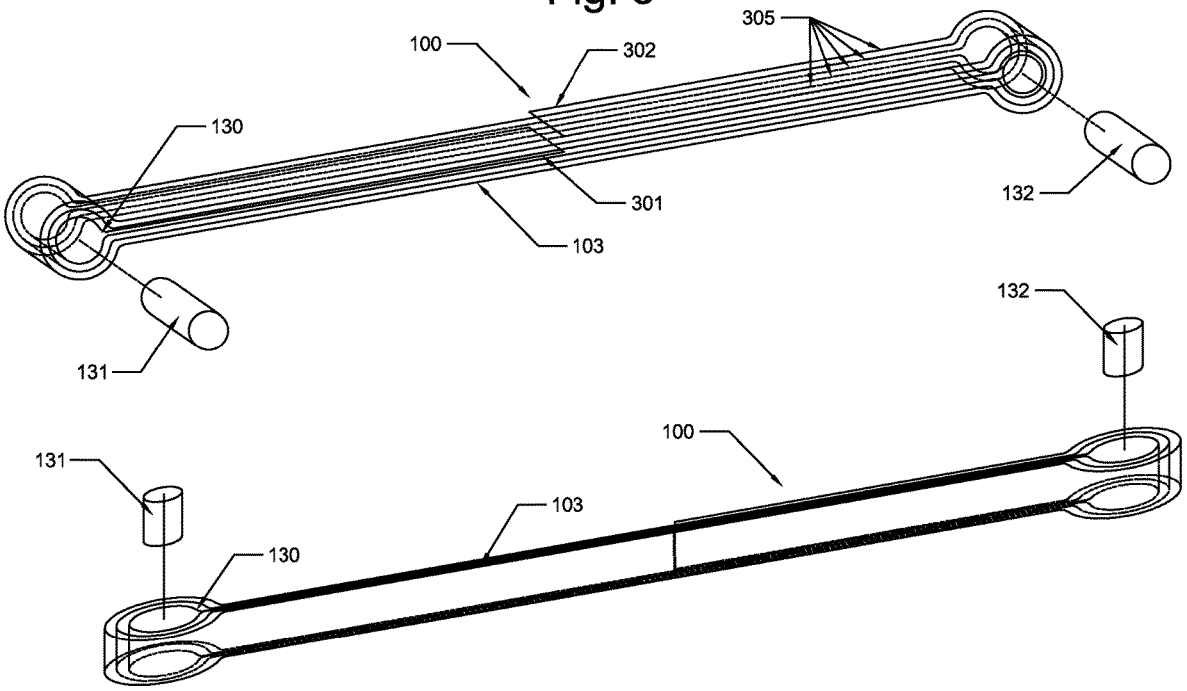
FIG. 3 is a partially transparent and exploded top and side view (above) showing a first end and a second end of a carbon fiber strip comprising a CCRD and a partially transparent, exploded top perspective and side perspective view (below) showing the second end of the carbon fiber strip comprising of a CCRD, according to an embodiment.

FIG. 3 is a partially transparent and exploded top and side view (above) showing a first end 301 and a second end of a carbon fiber strip comprising a CCRD 100 and a partially transparent, exploded top perspective and side perspective view (below) showing the second end 302 of the carbon fiber strip comprising of a CCRD, according to an embodiment. In this view the thickness of the carbon fiber strip 130 has been exaggerated so that it can more clearly be seen that the carbon fiber strip 130 has been wound back and forth around two pieces of carbon fiber rebar 131, 132. In FIG. 3 the carbon fiber strip 130 is first wrapped around a first piece of carbon fiber rebar 131 then across the length of the connecting strip of carbon fiber 103 then around the second piece of carbon fiber rebar 132 and back again. In this embodiment, this process is repeated five times in order to achieve the desired thickness of the CCRD 100. However, as mentioned above, the thickness of the CCRD 100 can be increased or decreased in order to achieve the tensile strength required for a particular application by adding or reducing the number of layers of carbon fiber material. In this embodiment, the first end 301 and the second end 302 are located in the middle connecting strip of carbon fiber 103 in their final positions.

In the partially transparent and exploded top and side view (above) of FIG. 3, lines of carbon fiber strands 305 are shown in exaggerated size to indicate their direction relative to the other parts of the CCRD 100.

FIGS. 4 thru 8 show the progression of steps which can be taken in order to install one or more CCRD 100 devices in order to stabilize and repair a crack 400 extending through a concrete wall 401 and concrete floor 402 according to an embodiment.

Figure 4:
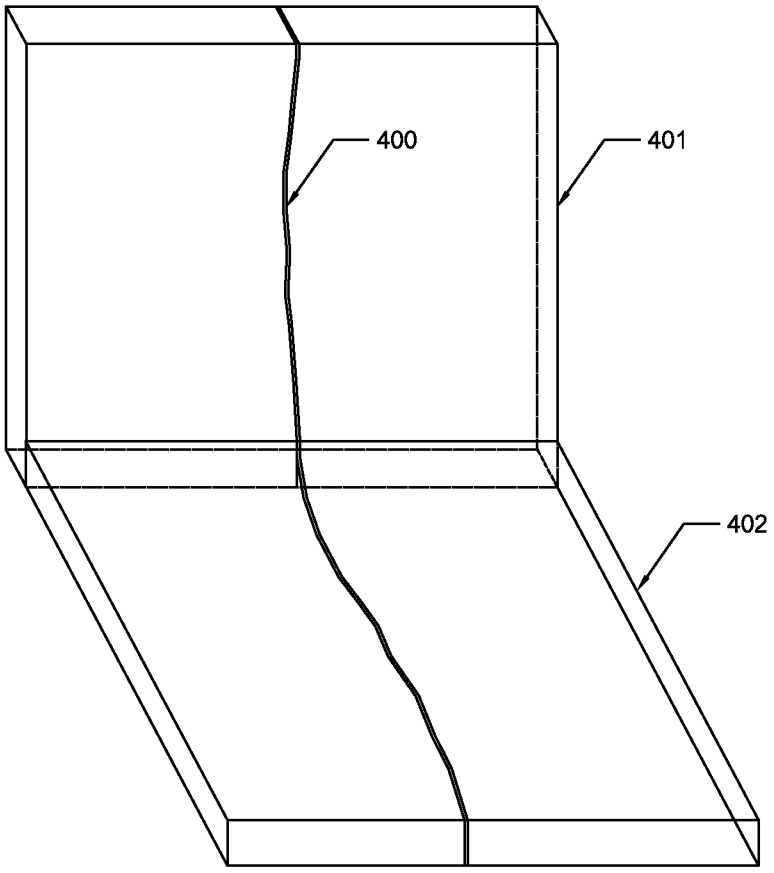
FIG. 4 is a top, front and side perspective view of a section of a concrete wall and a concrete floor, each comprising a crack spanning both.
Figure 4A:
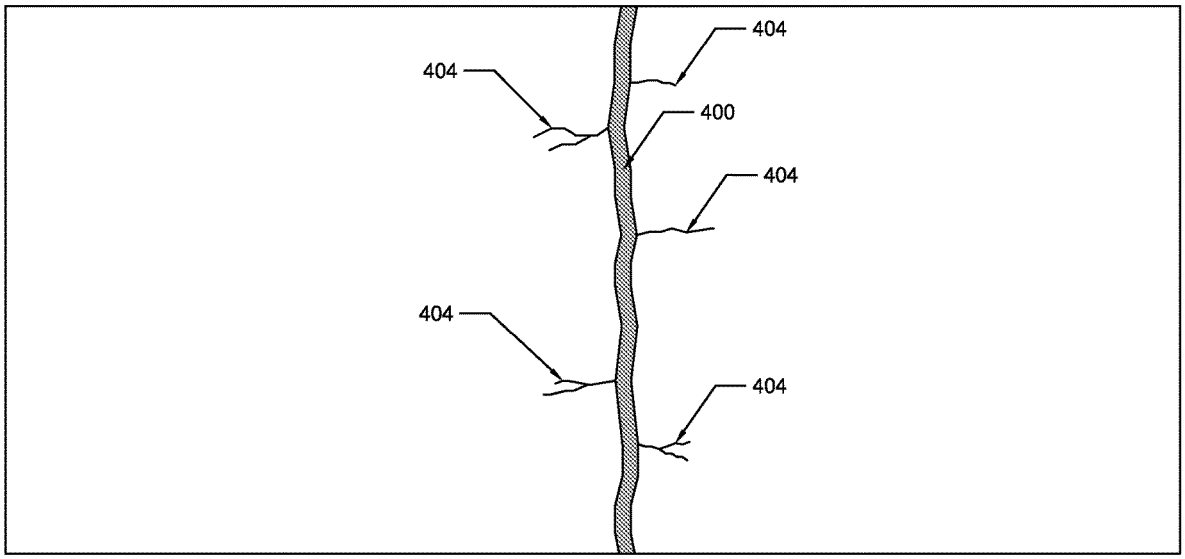
FIG. 4A is a magnified view of a small section of the crack shown in FIG. 4.

FIG. 4 is a top, front and side perspective view of a section of a concrete wall 401 and a concrete floor 402, each comprising a crack 400 spanning both. FIG. 4A is a magnified view of a small section of the crack 400 shown in FIG. 4. This view shows how small microfractures 404 can extend from a crack 400 further weakening the concrete wall 401 and concrete floor 402 containing the crack 400. For the CCRD 100 to be fully effective it must be of sufficient length so that its ends 113, 123 are anchored beyond the area of the wall 401 or floor 402 where the microfractures 404 exist.

Figure 5:
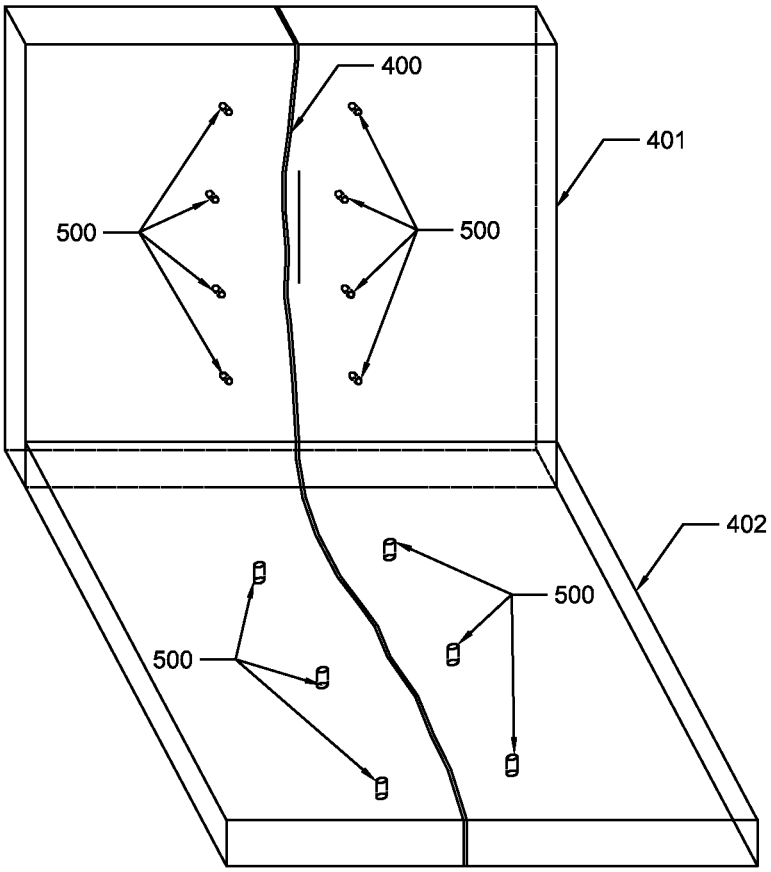
FIG. 5 is a top, front and side perspective view of the concrete wall and floor shown in FIG. 4, wherein holes have been drilled in predetermined locations on either side of the crack, according to an embodiment.
Figure 5A:
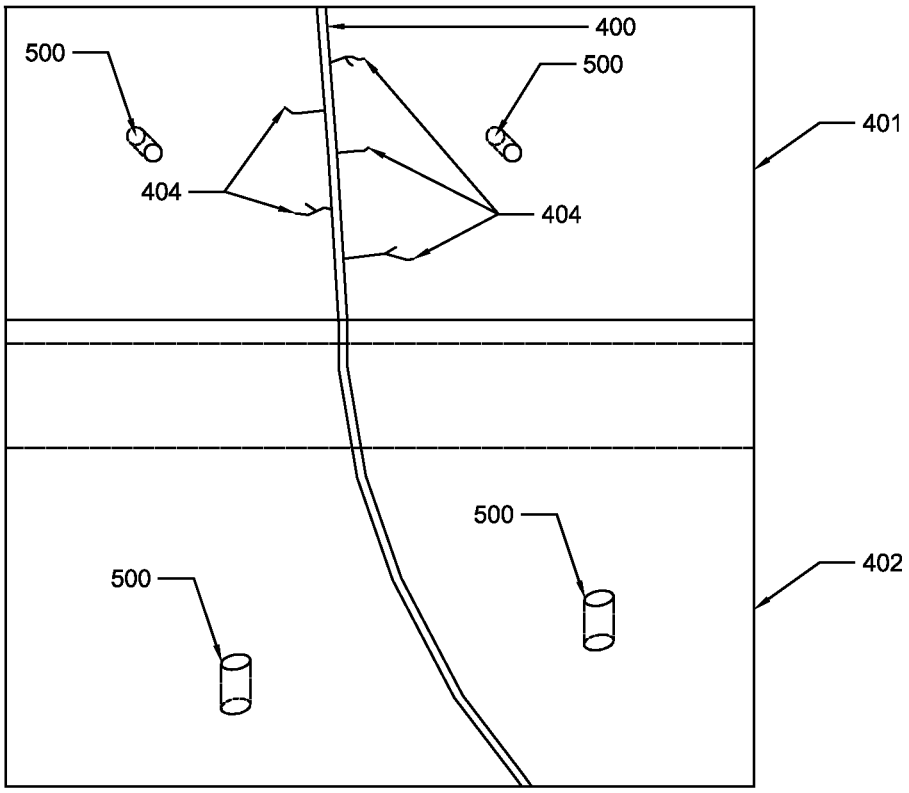
FIG. 5A is a magnified view of part of the concrete wall and floor shown in FIG. 5 wherein sets of two holes, which are shown in a transparent view, have been drilled in predetermined locations on either side of the crack, according to an embodiment.

FIG. 5 is a top, front and side perspective view of the concrete wall 401 and floor 402 shown in FIG. 4, wherein holes 500 have been drilled in predetermined locations on either side of the crack, according to an embodiment. FIG. 5A is a magnified view of part of the concrete wall 401 and floor 402 shown in FIG. 5 wherein sets of two holes 500, which are shown in a transparent view, have been drilled in predetermined locations on either side of the crack 400, according to an embodiment. As discussed, the holes 500 are located beyond the microfractures 404 so that the CCRD 100 is anchored in concrete that has not been weakened by either cracks 400 or microfractures 404, according to an embodiment. The holes 500 can typically be created by drilling into a wall 401 or floor 402 with a masonry bit of sufficient diameter that the resulting hole 500 is only slightly larger in diameter than the nodules 113, 123 comprising the CCRD 100. A jig (not pictured), pattern (not pictured) or similar device can be used to ensure that the holes 500 are located at the proper distance between them for the nodules 113, 123 comprising the CCRD 100 to fit within the holes 500.

Figure 6:
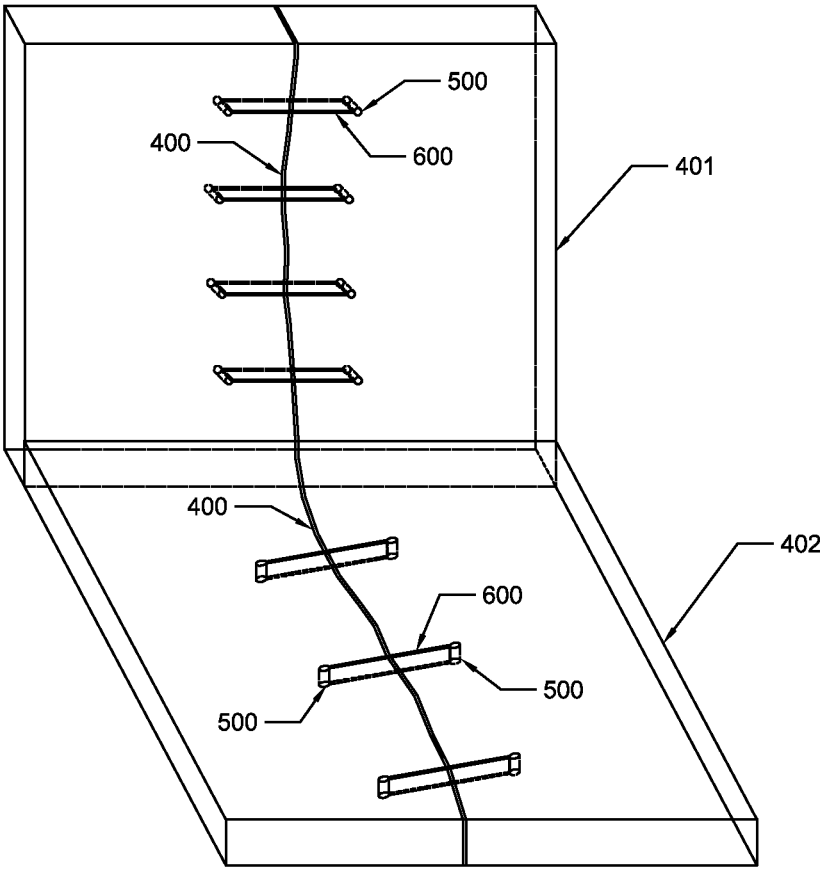
FIG. 6 is a top, front and side perspective view of the concrete wall and floor shown in FIGS. 4 and 5, wherein slots have been cut connecting each set of two holes drilled in predetermined locations on either side of the crack, wherein the holes and the slots are shown in transparent view, according to an embodiment.

FIG. 6 is a top, front and side perspective view of the concrete wall 401 and a floor 402 shown in FIGS. 4 and 5, wherein slots 600 have been cut connecting each set of two holes 500 drilled in predetermined locations on either side of the crack 400, wherein the holes 500 and the slots 400 are shown in transparent view, according to an embodiment. A jig, pattern etc. can also be used to ensure the proper location of the slot 600 which can be centered on two holes 500 connecting each set of two holes 500 with one slot 600, according to an embodiment. The slot 600, which can be created with a saw having a masonry blade (not pictured) need be no deeper than the depth of the holes 500 nor any wider than the connecting strip of carbon fiber 103. At a minimum, the slot 600 must be cut to a depth equal to the width of the CCRD 100 for the full width between the holes 500 in most embodiments. This is an important feature of the present apparatus and method for at least two reasons. First, concrete is a very hard material and cutting or drilling into it can create a great deal of hazardous dust. The present method requires minimal cutting and drilling compared to the other available crack repair solutions. The holes 500 and slots 600 needed for each CCRD 100 installation can be made in 1-2 minutes. The second important feature of the present apparatus and method is that by minimizing the amount of cutting and drilling required, the repair can cause less damage to the wall 401, floor 402, or other concrete surface being repaired, thus making the repair more visually appealing than more invasive crack repair solutions, which require more holes and thicker slots, or channels carved into the surface of the concrete.

Figure 6A:
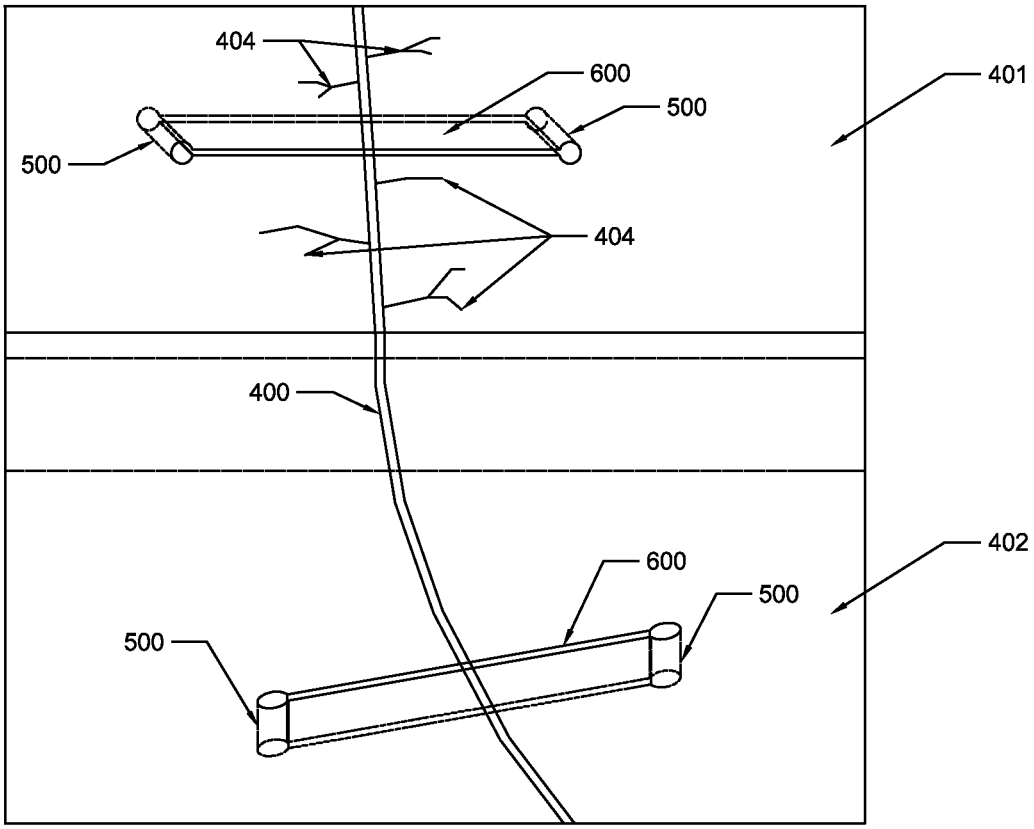
FIG. 6A is a magnified view of part of the concrete wall and floor shown in FIG. 6, wherein two slots have been cut each connecting one set comprising two holes drilled in predetermined locations on either side of the crack, wherein the holes and the slots are shown in transparent view in order to indicate their depth in the concrete wall and floor respectively, according to an embodiment.

FIG. 6A is a magnified view of part of the concrete wall and floor shown in FIG. 6, wherein two slots 600 have been cut each connecting one set comprising two holes 500 drilled in predetermined locations on either side of the crack 400, wherein the holes 500 and the slots 600 are shown in transparent view in order to indicate their depth in the concrete wall 401 and floor 402 relative to the dimensions of the CCRD 100, according to an embodiment.

Figure 7:
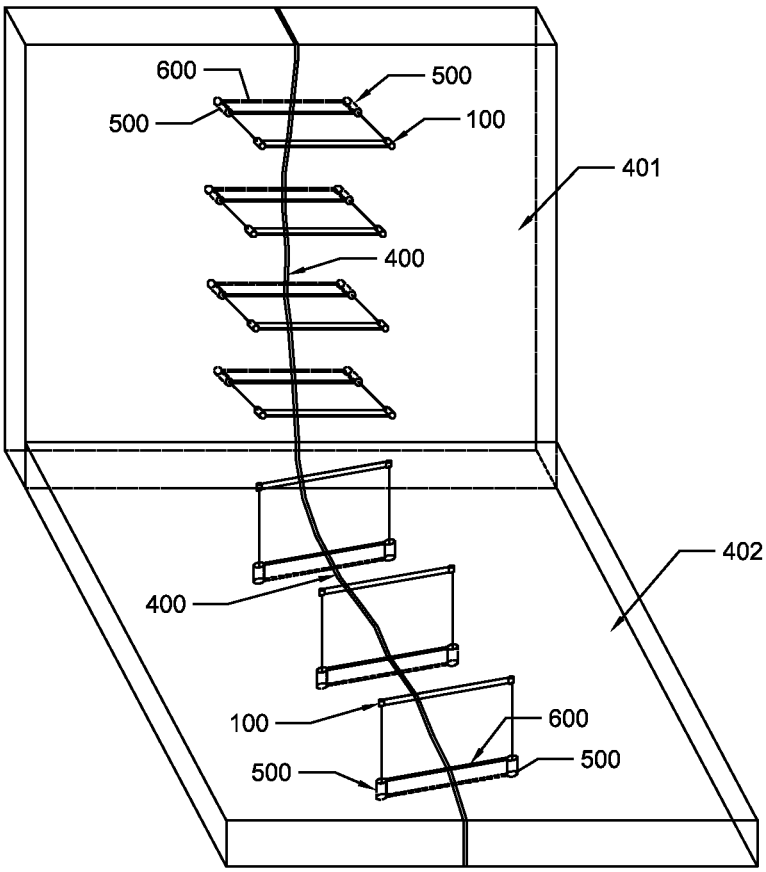
FIG. 7 is a top, front and side perspective view of the concrete wall and floor shown in FIG. 4, wherein slots have been cut connecting each set of two holes drilled in predetermined locations on either side of the crack, wherein the holes and the slots are shown in transparent view and a concrete crack repairing device is shown positioned over each set of holes connected by a slot, according to an embodiment.
Figure 7A:
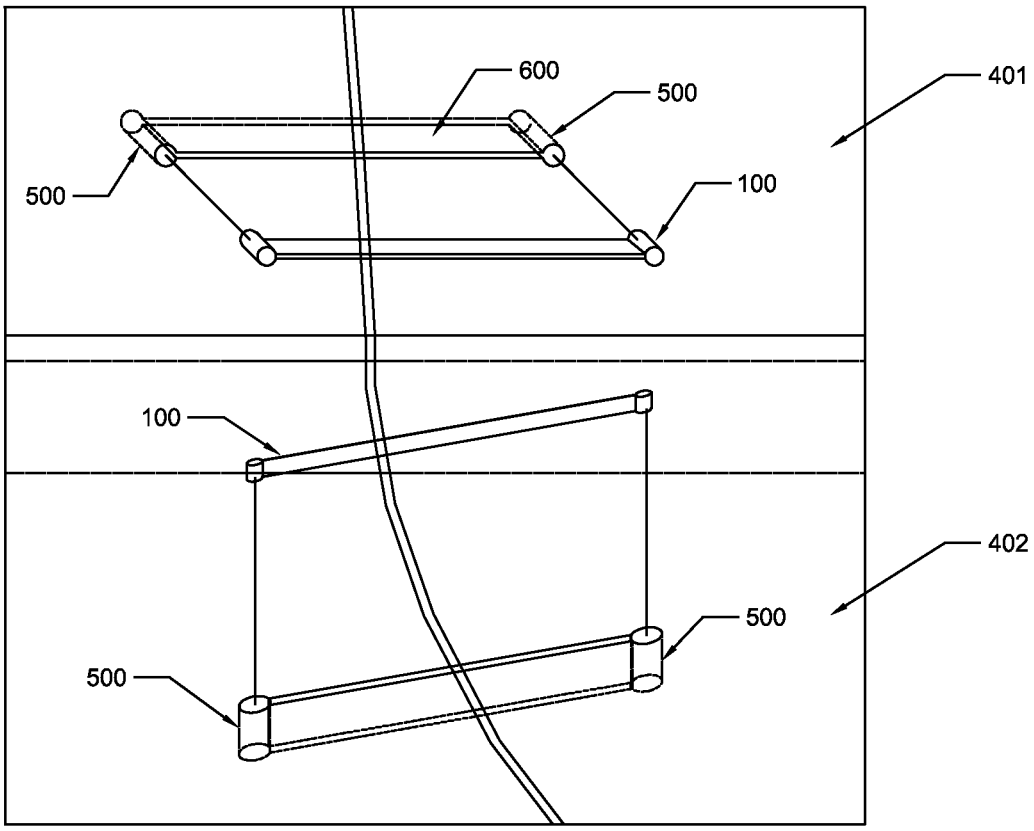
FIG. 7A is a magnified view of part of the concrete wall and floor shown in FIG. 7, wherein two slots have been cut connecting each set of two holes drilled in predetermined locations on either side of the crack, wherein the holes and the slots are shown in transparent view and a concrete crack repairing device is shown positioned over each set of holes connected by a slot, according to an embodiment.

FIG. 7 is a top, front and side perspective view of the concrete wall 401 and a floor 402 shown in FIG. 4, wherein slots 600 have been cut connecting each set of two holes 500 drilled in predetermined locations on either side of the crack 400, wherein the holes 500 and the slots 600 are shown in transparent view and a CCRD 100 is shown positioned over each set of holes 500 connected by a slot 600, according to an embodiment. FIG. 7A is a magnified view of part of the concrete wall 401 and floor 402 shown in FIG. 7, wherein two slots 600 have been cut connecting each set of two holes 500 drilled in predetermined locations on either side of the crack 400, wherein the holes 500 and the slots 600 are shown in transparent view and a CCRD is shown positioned over each set of holes 500 connected by the slot 600, according to an embodiment. FIG. 7A clearly shows how the size and shape of the CCRD 100 can correspond to the size and shape of each pair of holes 500 connected by a slot 600.

Figure 7B:
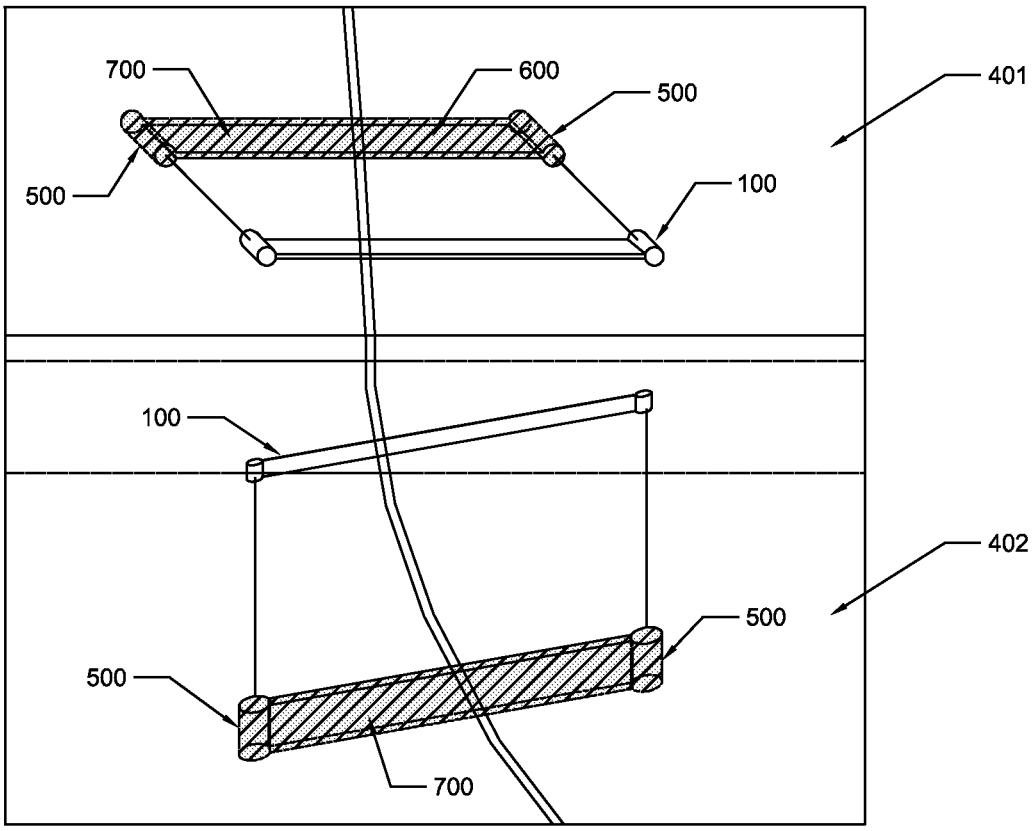
FIG. 7B is a magnified view of part of the concrete wall and floor shown in FIG. 7, wherein two slots have been cut connecting each set of two holes drilled in predetermined locations on either side of the crack, wherein the holes and the slots are shown in transparent view and a concrete crack repairing device is shown positioned over each set of holes connected by a slot and wherein the slot and holes have been at least partially filled with an epoxy or similar substance, according to an alternative embodiment.

FIG. 7B is a magnified view of part of the concrete wall 401 and floor 403 shown in FIG. 7, wherein two slots 600 have been cut connecting each set of two holes 500 drilled in predetermined locations on either side of the crack 400, wherein the holes 500 and the slots 600 are shown in transparent view and a CCRD 100 is shown positioned over each set of holes 500 connected by a slot 600 and wherein the slot 600 and holes 500 have been at least partially filled with an epoxy 700 or similar substance, according to an alternative embodiment.

Figure 8:
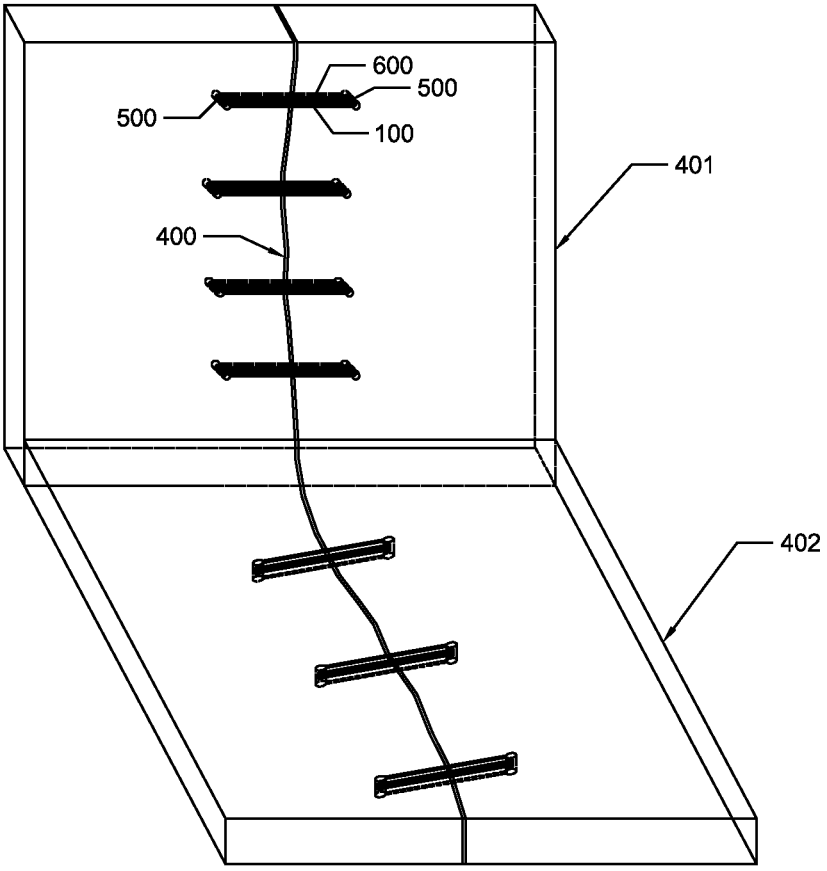
FIG. 8 is a top, front and side perspective view of the concrete wall and floor shown in FIG. 4, wherein slots have been cut connecting each set of two holes drilled in predetermined locations on either side of the crack, wherein the holes and the slots are shown in transparent view and a concrete crack repairing device has been placed in each set of holes connected by a slot, according to an embodiment.
Figure 8A:
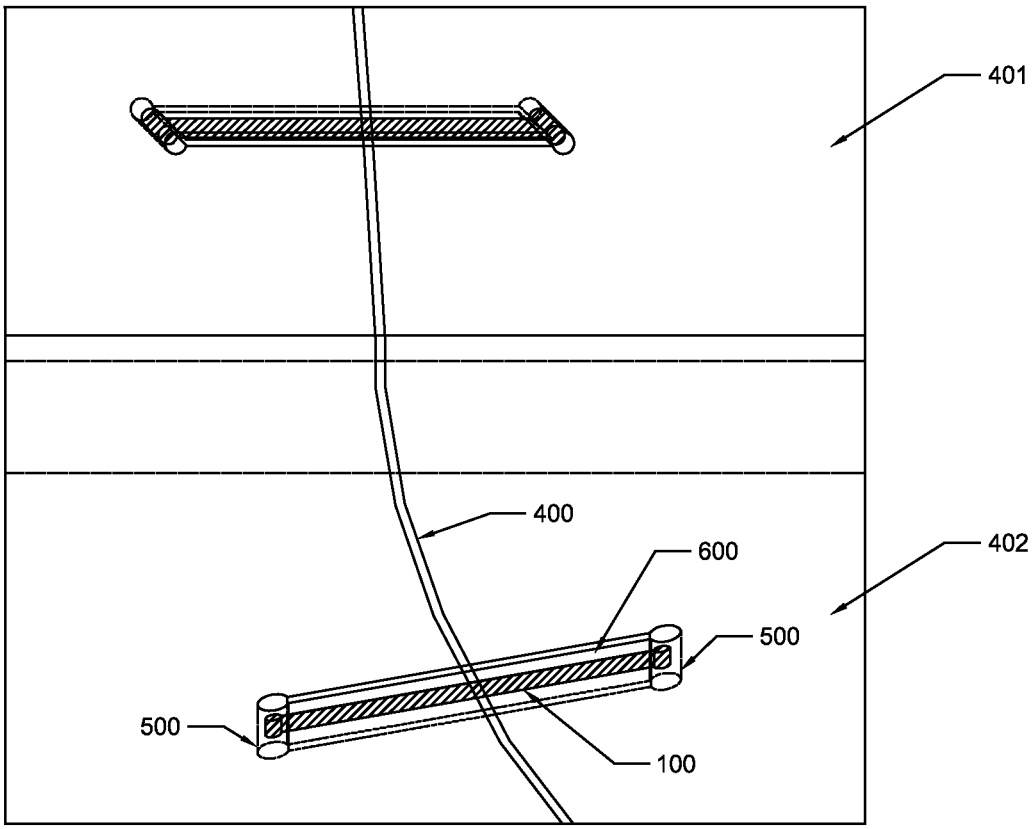
FIG. 8A is a magnified view of part of the concrete wall and floor shown in FIG. 8, wherein two slots have been cut connecting each set of two holes drilled in predetermined locations on either side of the crack, wherein the holes and the slots are shown in transparent view and a concrete crack repairing device has been placed in each set of holes connected by a slot, according to an embodiment.

FIG. 8 is a top, front and side perspective view of the concrete wall 401 and floor 402 shown in FIGS. 4, 5, 6 and 7, wherein slots 600 have been cut connecting each set of two holes 500 drilled in predetermined locations on either side of the crack 400, wherein the holes 500 and the slots 600 are shown in transparent view and CCRDs 100 have been placed in each set of holes 500 connected by a slot 600 respectively, according to an embodiment. FIG. 8A is a magnified view of part of the concrete wall 401 and floor 402 shown in FIG. 8, wherein two slots 600 have been cut connecting each set of two holes 500 drilled in predetermined locations on either side of the crack 400, wherein the holes and the slots are shown in transparent view and a CCRD 100 has been placed in each set of holes 500 connected by a slot 600, according to an embodiment.

Figure 8B:
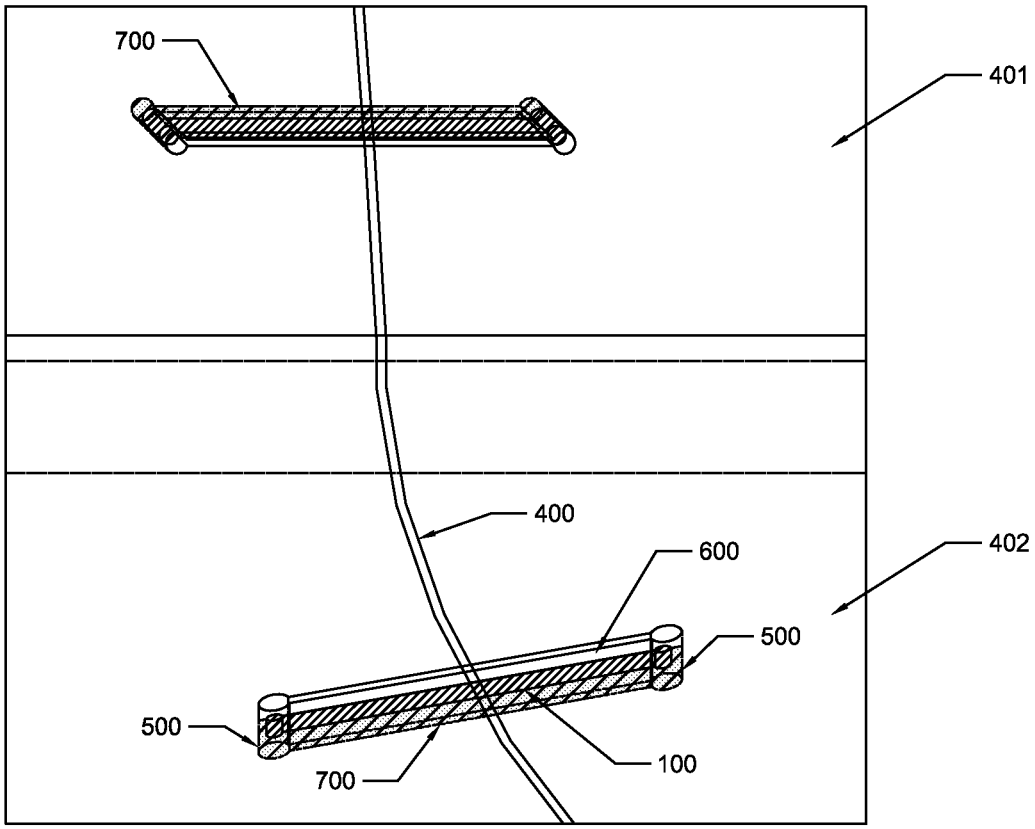
FIG. 8B is a magnified view of part of the concrete wall and floor shown in FIG. 8, but in the alternative embodiment shown in FIG. 7A, wherein two slots have been cut connecting each set of two holes drilled in predetermined locations on either side of the crack, wherein the holes and the slots are shown in transparent view and a concrete crack repairing device has been placed in each set of holes connected by a slot and wherein the slot and holes have been at least partially filled with an epoxy or similar substance before the concrete crack repairing device has been placed into the slot and holes, according to an alternative embodiment.
Figure 8C:
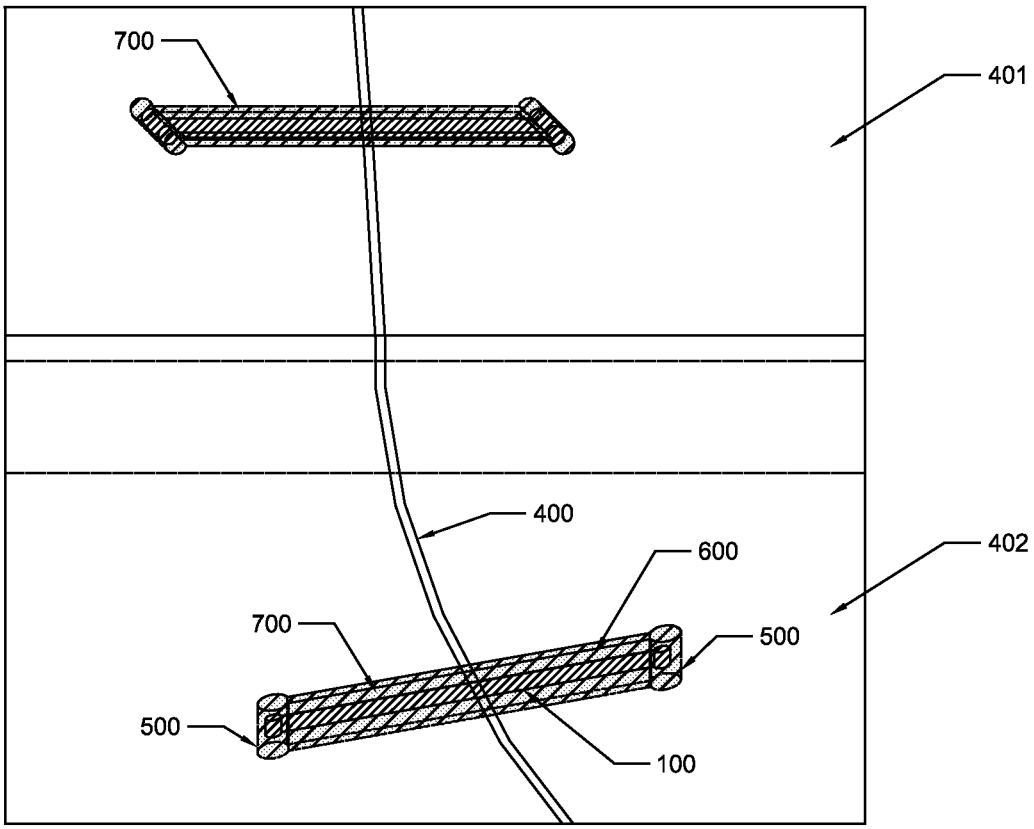
FIG. 8C is a magnified view of part of the concrete wall and floor shown in FIGS. 8 and 8B, but in the alternative embodiment shown in FIG. 7A, wherein two slots have been cut connecting each set of two holes drilled in predetermined locations on either side of the crack, wherein the holes and the slots are shown in transparent view and a concrete crack repairing device has been placed in each set of holes connected by a slot and wherein the slot and holes have been at least partially filled with an epoxy or similar substance before the concrete crack repairing device has been placed into the slot and holes and voids and holed in the slot and holed have been filled in with an additional amount of epoxy after the concrete crack repairing device has been placed into the slot and holes, according to an alternative embodiment.

FIG. 8B is a magnified view of part of the concrete wall 401 and floor 402 shown in FIG. 8, but in the alternative embodiment shown in FIG. 7A, wherein two slots 600 have been cut connecting each set of two holes 500 drilled in predetermined locations on either side of the crack 400, wherein the holes 500 and the slots 600 are shown in transparent view and a CCRD 100 has been placed in each set of holes 500 connected by a slot 600 and wherein the slot and holes have been at least partially filled with an epoxy 700 or similar substance before each CCRD 100 has been placed into the slot 600 and holes 500, according to an alternative embodiment. Similarly, FIG. 8C is a magnified view of part of the concrete wall 401 and floor 402 shown in FIGS. 8 and 8B, but in the alternative embodiment shown in FIGS. 7A and 8B, wherein two slots 600 have been cut connecting each set of two holes 500 drilled in predetermined locations on either side of the crack 400, wherein the holes 500 and the slots 600 are shown in transparent view and a CCRD 100 has been placed in each set of holes 500 connected by a slot 600 and wherein the slot 600 and holes 500 have been at least partially filled with an epoxy 700 or similar substance before each CCRD 100 has been placed into the slot 600 and holes 500 and wherein voids and holes (not shown) in the slot 600 and holes 500 have been filled in with an additional amount of epoxy 700 after the CCRD has been placed into the slot 600 and holes 500, according to an alternative embodiment.

Figure 9:
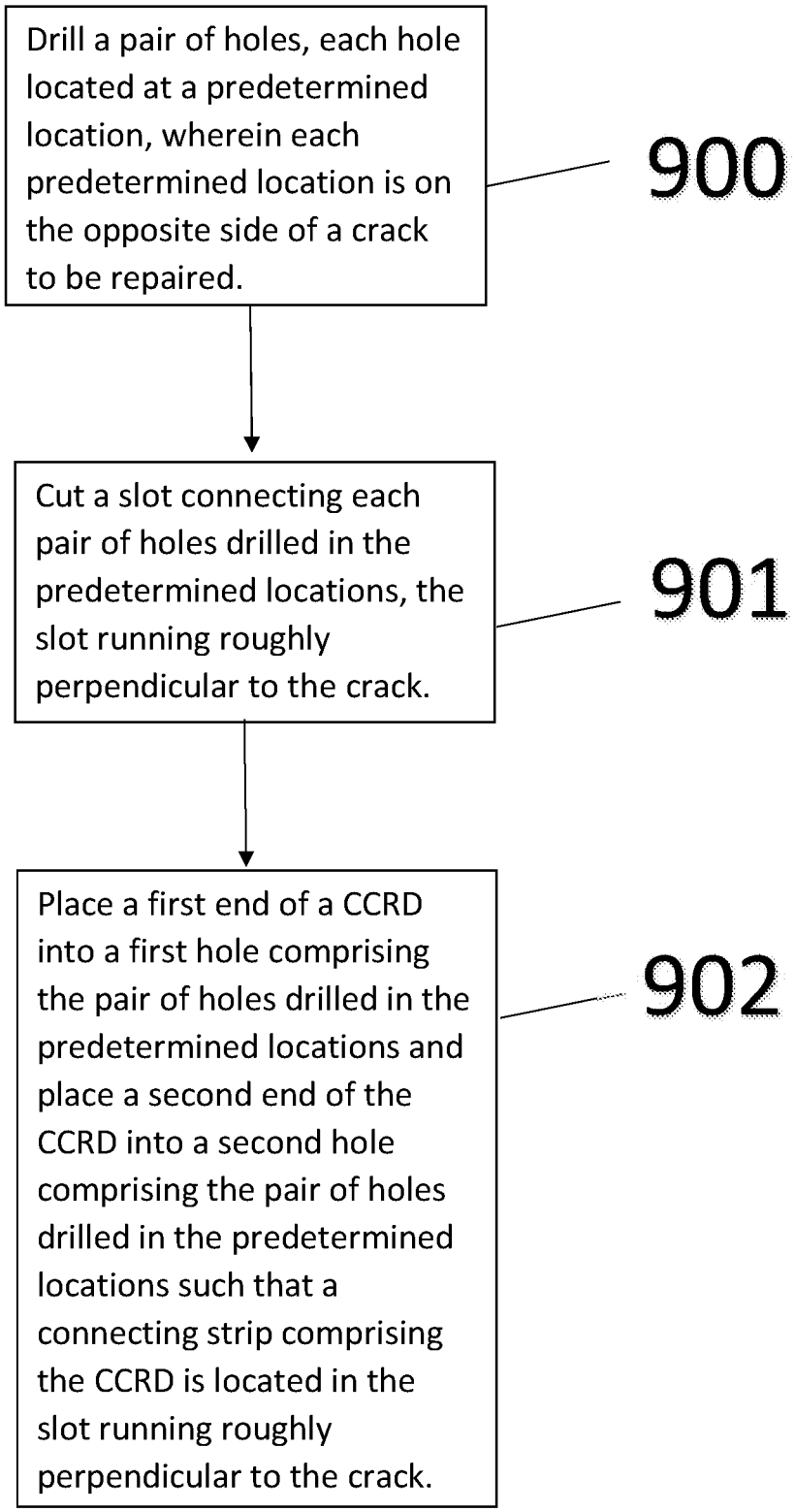
FIG. 9 is a flowchart comprising the steps of a method for installing a CCRD according to an embodiment.

Need FIG. 9 is a flowchart listing the steps to follow when installing a CCRD according to an embodiment.

Figure 10:
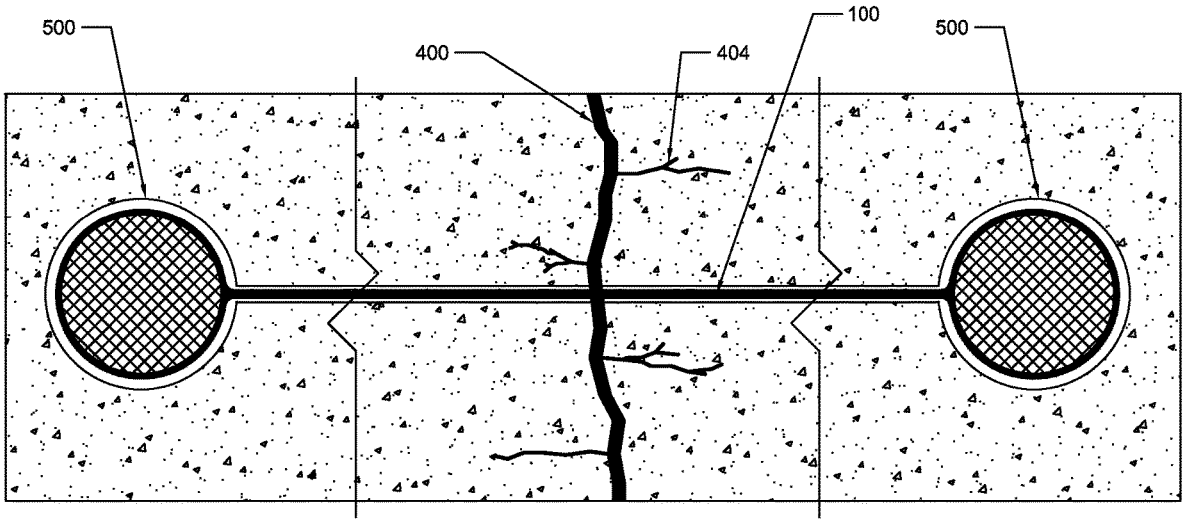
FIG. 10 is a top magnified view of a concrete crack repairing device placed in each set of holes connected by a slot, spanning a crack comprising microfractures, according to an embodiment.

FIG. 10 is a top magnified view of a CCRD 100 placed in each set of holes 500 connected by a slot 600, spanning a crack 400 comprising microfractures 404, according to an embodiment. This figure is intended to show in more fine detail how the CCRD 100 could be seated within the set of holes 500 and slot 600 according to an embodiment.

FIGS. 11 thru 14 demonstrate the steps of the CCRD installation, which are also shown in FIGS. 4 thru 8. However, these figures show only one CCRD being installed and utilizes a close-up, cut-away view of the installation process to provide a different perspective.

Figure 11:
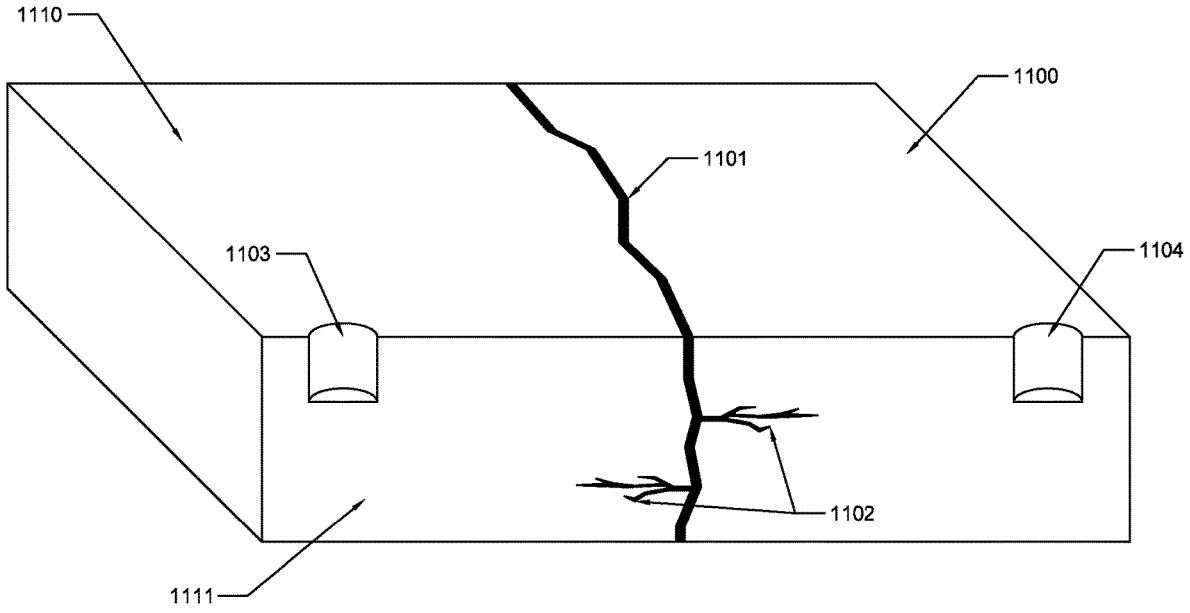
FIG. 11 is a top, front and side cutaway view of a section of concrete floor comprising a crack with microfractures wherein a set of two holes have been drilled into the floor at predetermined locations on either side of the crack according to an embodiment.

FIG. 11 is a top, front and side cutaway view of a section of concrete floor 1100 comprising a crack 1101 with microfractures 1102 wherein a set of two holes 1103, 1104 have been drilled into the floor 1100 at predetermined locations on either side of the crack 1101 according to an embodiment. In this embodiment, the first hole 1103 and the second hole 1104 are each approximately equidistant from the crack 1101 and neither is in contact with the crack 1101 or its microfractures 1102. In this cutaway view, it can be seen that the holes 1103 and 1104 are drilled into the top surface 1110 of the concrete floor at an angle perpendicular to the plane of the top surface 1110 and parallel to the front cutaway surface 1111.

Figure 12:
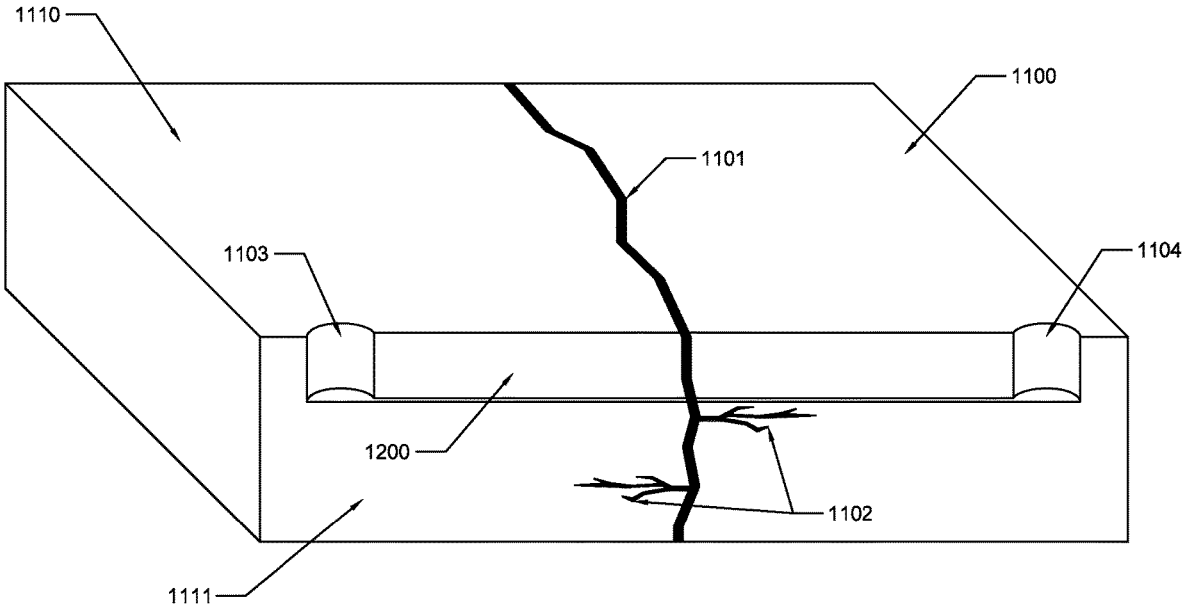
FIG. 12 is a top, side and front side cutaway view of a section of concrete floor comprising a crack with microfractures wherein a set of two holes have been drilled into the floor at predetermined locations on either side of the crack and wherein a slot has been cut into the floor connecting the set of two holes according to an embodiment.

FIG. 12 is a top, side and front side cutaway view of a section of concrete floor 1100 comprising a crack 1101 with microfractures 1102 wherein the first hole 1103 and the second hole 1104 have been drilled into the floor 1100 at predetermined locations on either side of the crack 1101 and wherein a slot 1200 has been cut into the floor 1100 connecting the first hole 1103 and the second hole 1104, according to an embodiment. Once the first hole 1103 and the second hole 1104 have been drilled and the slot 1200 has been cut the floor 1100 is prepared for the CCRD (not pictured in FIG. 12) installation.

Figure 13:
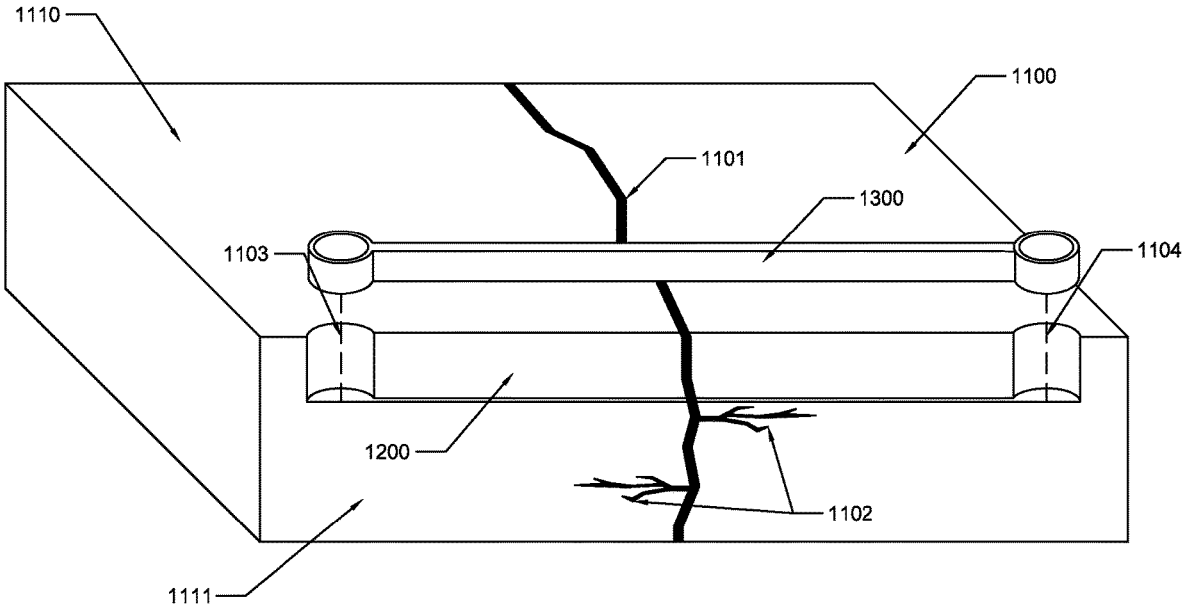
FIG. 13 is a top, side and front cutaway view of a section of concrete floor comprising a crack with microfractures wherein a set of two holes have been drilled into the floor at predetermined locations on either side of the crack and wherein a slot has been cut into the floor connecting the set of two holes and a concrete repair device is located above the set of holes and slot according to an embodiment.

FIG. 13 is a top, side and front cutaway view of a section of concrete floor 1100 comprising a crack 1101with microfractures 1102 wherein a first hole 1103 and the second hole 1104 have been drilled into the floor 1100 at predetermined locations on either side of the crack 1101 and wherein a slot 1200 has been cut into the floor 1100 connecting the first hole 1103 and the second hole 1104 and a CCRD 1300 is located above the first hole 1103, second hole 1104 and slot 1200, according to an embodiment.

Figure 14:
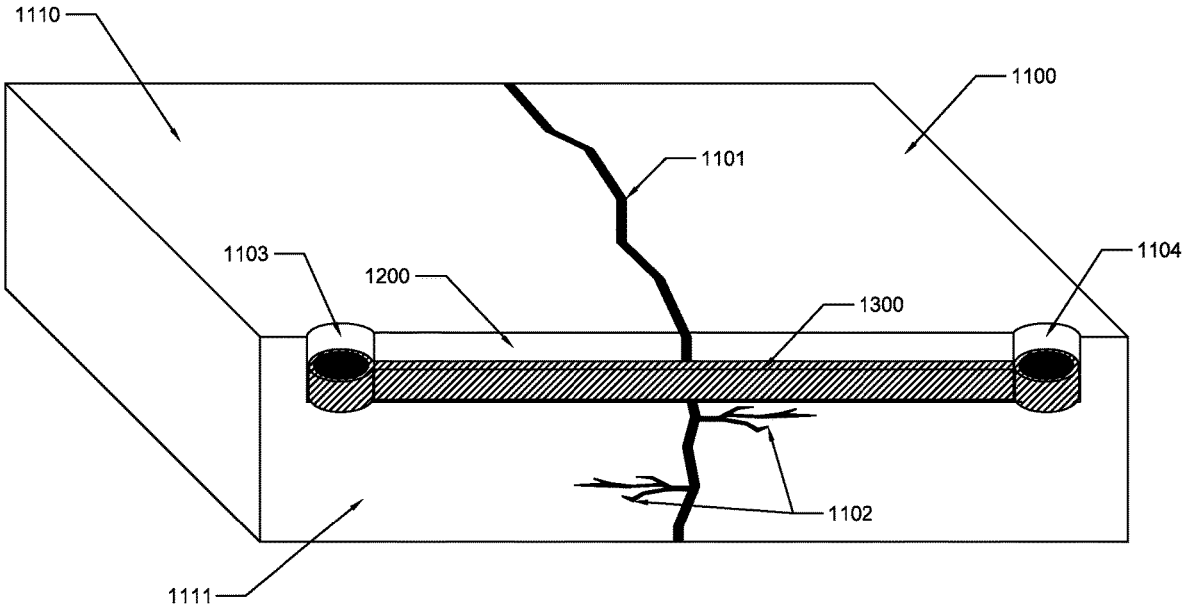
FIG. 14 is a top, side and front cutaway view of a section of concrete floor comprising a crack with microfractures wherein a set of two holes have been drilled into the floor at predetermined locations on either side of the crack and wherein a slot has been cut into the floor connecting the set of two holes and a concrete repair device installed into the set of holes and slot according to an embodiment.

FIG. 14 is a top, side and front cutaway view of a section of concrete floor 1100 comprising a crack with microfractures 1102 wherein a first hole 1103 and the second hole 1104 have been drilled into the floor 1100 at predetermined locations on either side of the crack 1101 and wherein a slot 1200 has been cut into the floor 1100 connecting the a first hole 1103 and the second hole 1104 and a CCRD 1300 is installed into the a first hole 1103, second hole 1104 and slot 1200, according to an embodiment. In an embodiment, epoxy can be added into any or all the first hole 1103, second hole 1104 and slot 1200 in order to ensure that all voids are filled and the CCRD 1300 remains in place. However, in other embodiments no epoxy is required. Additionally, the holes 1103, 1104 and slot 1200 can be filled with grout, caulk, epoxy or other similar material that meet the desired bond and compressive strength requirements. Filing the voids around the CCRD will also prevent moisture or debris from getting into the holes 1103, 1104 and slot 1200 and will make the repair more visually appealing.

Figure 15:
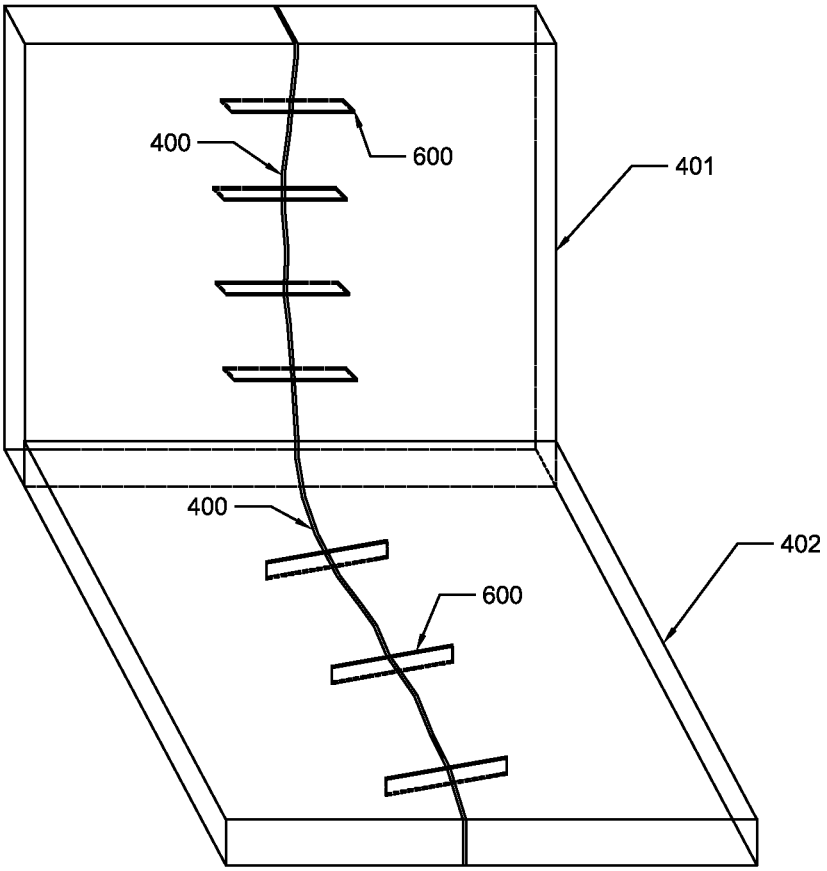
FIG. 15 is a top, front and side perspective view of the concrete wall and floor shown in FIG. 4, wherein one or more slots have been cut in predetermined locations across the crack before any holes have been drilled into the wall or floor, according to an alternative embodiment.
Figure 15A:
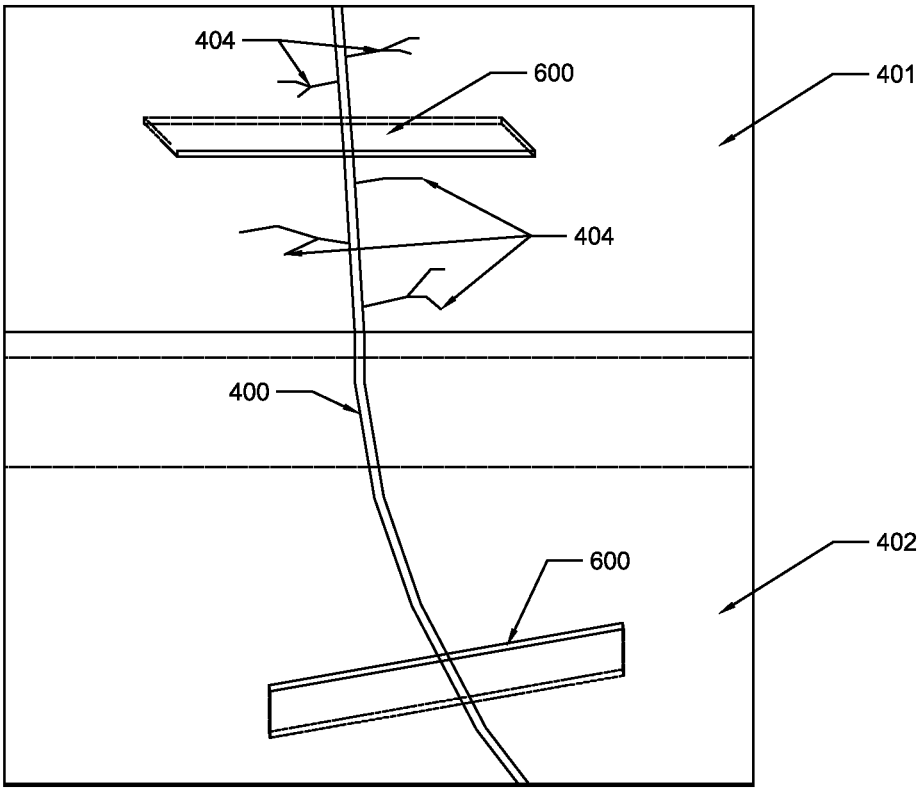
FIG. 15A is a magnified view of part of the concrete wall and floor shown in FIG. 15 wherein one or more slots have been cut in predetermined locations across the crack before any holes have been drilled into the wall or floor, according to an alternative embodiment.

FIG. 15 is a top, front and side perspective view of the concrete wall 401 and floor 402 shown in FIG. 4, wherein one or more slots 600 have been cut in predetermined locations across the crack 400 before any holes have been drilled into the wall or floor, according to an alternative embodiment. This embodiment shows that it is contemplated that the slots 600 can be cut first and the holes added to the ends of the slots 600 afterward. FIG. 15A is a magnified view of part of the concrete wall 401and floor 402 shown in FIG. 15 wherein one or more slots 600 have been cut in predetermined locations across the crack 400 before any holes have been drilled into the wall or floor, according to an alternative embodiment. After the holes are drilled at the ends of each slot 600, the next step will look identical to the wall 401 and floor 402 shown in FIGS. 6 and 6A and the steps depicted in FIGS. 7 thru 8C can be followed by following exactly the same methods as described for those steps.

Figure 16:
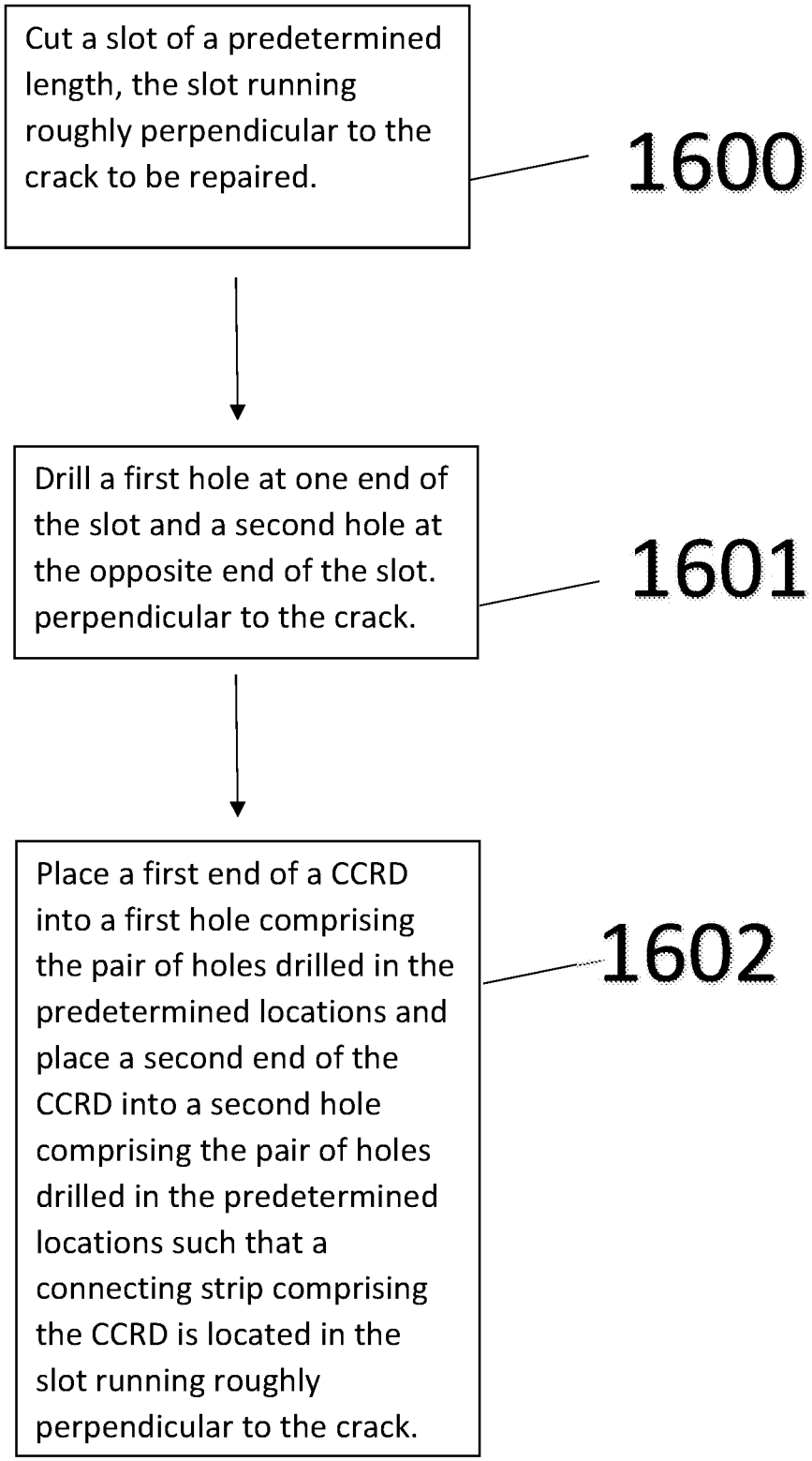
FIG. 16 is a flowchart comprising the steps of a method for installing a CCRD according to an alternative embodiment.

FIG. 16 is a flowchart comprising the steps of a method for installing a CCRD according to an alternative embodiment, wherein the slots are cut first and the holes are drilled afterward.

Figure 17:
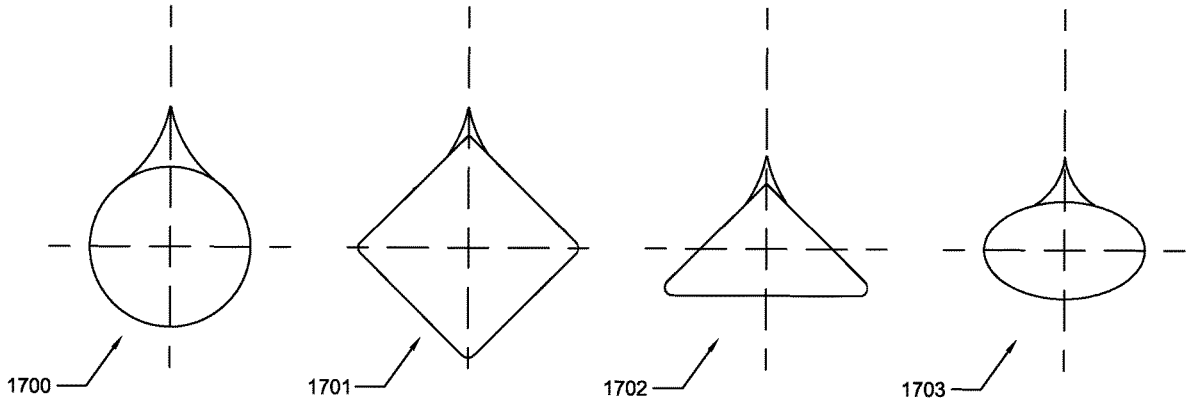
FIG. 17 is a top view of four first ends, each comprising a first nodule of the CCRD, wherein the ends are circular, square, triangular, and oval-shaped, according to alternative embodiments.

FIG. 17 is a top view of four first ends, each comprising a first nodule of the CCRD, wherein the ends are cylindrical 1700, square 1701, triangular 1702, and oval-shaped 1703 respectively, according to alternative embodiments.

Although the present apparatus and methods have been described in terms of exemplary embodiments, none is limited thereto. Rather, the appended claims should be construed broadly, to include other variants and embodiments of the present device and methods, which may be made by those skilled in the art without departing from the scope and range of equivalents of either the device or the methods of using the device.

What is claimed is:

1. A method for installing a concrete crack repair device comprising:

providing a concrete crack repair device comprising an elongated strip of carbon fibers, wherein substantially all of the carbon fibers are located within a plane, and wherein the elongated strip of carbon fibers comprises a first end and a second end and the elongated strip of carbon fibers comprises a first nodule at the first end and a second nodule at the second end, wherein the first nodule comprises a first nodule hole and the second nodule comprises a second nodule hole, and wherein the first nodule is connected to the second nodule by a connecting strip of carbon fiber which is also comprised of the same elongated strip of carbon fibers, and wherein the connecting strip is narrower than both the first nodule and second nodule in at least one plane; providing a concrete surface comprising at least one crack to be repaired, wherein the crack has a first side and second side;

drilling a first hole in the concrete surface sufficient to contain the first nodule on the first side of the crack to be repaired and drilling a second hole on the second side of the crack to be repaired;

cutting a slot connecting the first hole to the second hole; and placing the concrete crack repair device in the concrete surface by placing the first nodule in the first hole and the second nodule in the second hole so that the connecting strip is located in the slot.

2. The method for installing a concrete crack repair device described in claim 1 wherein the first nodule hole and the second nodule hole each comprise carbon fiber rebar.

3. The method for installing a concrete crack repair device described in claim 2 wherein the carbon fiber rebar is cylindrical in shape.

4. A method for installing a concrete crack repair device comprising:

providing a concrete crack repair device comprising an elongated strip of carbon fibers, wherein substantially all of the carbon fibers are located within a plane, and wherein the elongated strip of carbon fibers comprises a first end and a second end and the elongated strip of carbon fibers comprises a first nodule at the first end and a second nodule at the second end, wherein the first nodule, second nodule and connecting strip are all comprised of a single strip of carbon fiber fabric and wherein the first nodule is connected to the second nodule by a connecting strip of carbon fiber which is also comprised of the same elongated strip of carbon fibers, and wherein the connecting strip is narrower than both the first nodule and second nodule in at least one plane; providing a concrete surface comprising at least one crack to be repaired, wherein the crack has a first side and second side;

drilling a first hole in the concrete surface sufficient to contain the first nodule on the first side of the crack to be repaired and drilling a second hole on the second side of the crack to be repaired;

cutting a slot connecting the first hole to the second hole; and placing the concrete crack repair device in the concrete surface by placing the first nodule in the first hole and the second nodule in the second hole so that the connecting strip is located in the slot.

5. The method for installing a concrete crack repair device described in claim 4 wherein the single strip of carbon fiber fabric is wound in layers against itself to create the first nodule, the second nodule and the connecting strip.

6. A method for installing a concrete crack repair device comprising: providing a concrete crack repair device comprising an elongated strip of carbon fibers, wherein substantially all of the carbon fibers are located within a plane, and wherein the elongated strip of carbon fibers comprises a first end and a second end and the elongated strip of carbon fibers comprises a first nodule at the first end and a second nodule at the second end, wherein the first nodule comprises a first nodule hole and the second nodule comprises a second nodule hole and wherein the first nodule is connected to the second nodule by a connecting strip of carbon fiber which is also comprised of the same elongated strip of carbon fibers and wherein the connecting strip is narrower than both the first nodule and second nodule in at least one plane;

providing a concrete surface comprising at least one crack to be repaired, wherein the crack has a first side and second side;

cutting a slot of a predetermined length roughly across and perpendicular to the one crack to be repaired, wherein the slot has a first end and a second end;

drilling a first hole at the first end of the slot sufficient to contain the first nodule and a second hole at the second end of the slot sufficient to contain the second nodule; and placing the concrete crack repair device in the concrete surface by placing the first nodule in the first hole and the second nodule in the second hole so that the connecting strip is located in the slot.

7. The method for installing a concrete crack repair device described in claim 6 wherein the first nodule hole and the second nodule hole each comprise carbon fiber rebar.

8. The method for installing a concrete crack repair device described in claim 7 wherein the carbon fiber rebar is cylindrical in shape.

9. A method for installing a concrete crack repair device comprising: providing a concrete crack repair device comprising an elongated strip of carbon fibers, wherein substantially all of the carbon fibers are located within a plane, and wherein the elongated strip of carbon fibers comprises a first end and a second end and the elongated strip of carbon fibers comprises a first nodule at the first end and a second nodule at the second end, wherein the first nodule, second nodule and connecting strip are all comprised of a single strip of carbon fiber fabric and wherein the first nodule is connected to the second nodule by a connecting strip of carbon fiber which is also comprised of the same elongated strip of carbon fibers and wherein the connecting strip is narrower than both the first nodule and second nodule in at least one plane;

providing a concrete surface comprising at least one crack to be repaired, wherein the crack has a first side and second side;

cutting a slot of a predetermined length roughly across and perpendicular to the one crack to be repaired, wherein the slot has a first end and a second end;

drilling a first hole at the first end of the slot sufficient to contain the first nodule and a second hole at the second end of the slot sufficient to contain the second nodule; and placing the concrete crack repair device in the concrete surface by placing the first nodule in the first hole and the second nodule in the second hole so that the connecting strip is located in the slot.

10. The method for installing a concrete crack repair device described in claim 9 wherein the single strip of carbon fiber fabric is wound in layers against itself to create the first nodule, the second nodule and the connecting strip.

* * * * *